US010837210B2

(12) United States Patent
Yamaguchi

(10) Patent No.: US 10,837,210 B2
(45) Date of Patent: Nov. 17, 2020

(54) HINGE AND HINGE BRACKET

(71) Applicant: Sugatsune Kogyo Co., Ltd., Tokyo (JP)

(72) Inventor: Koushi Yamaguchi, Tokyo (JP)

(73) Assignee: SUGATSUNE KOGYO CO., LTD., Tokyo (JP)

( * ) Notice: Subject to any disclaimer, the term of this patent is extended or adjusted under 35 U.S.C. 154(b) by 0 days.

(21) Appl. No.: 15/756,934

(22) PCT Filed: Jun. 29, 2016

(86) PCT No.: PCT/JP2016/069279
§ 371 (c)(1),
(2) Date: Mar. 1, 2018

(87) PCT Pub. No.: WO2017/038228
PCT Pub. Date: Mar. 9, 2017

(65) Prior Publication Data

US 2018/0252011 A1 Sep. 6, 2018

(30) Foreign Application Priority Data

Sep. 4, 2015 (JP) ..... 2015-174489

(51) Int. Cl.
*E05D 3/16* (2006.01)
*E05D 5/02* (2006.01)
*E05D 3/18* (2006.01)

(52) U.S. Cl.
CPC ..... *E05D 3/16* (2013.01); *E05D 5/0246* (2013.01); *E05D 3/186* (2013.01);
(Continued)

(58) Field of Classification Search
CPC ..... E05D 3/16; E05D 5/0246; E05Y 2900/20
See application file for complete search history.

(56) References Cited

U.S. PATENT DOCUMENTS 1,030,936 A * 7/1912 Soss ..... E05D 3/16 16/369
1,280,357 A * 10/1918 Zuckerman ..... E05D 3/16 16/369

(Continued)

FOREIGN PATENT DOCUMENTS

EP 0206859 A1 12/1986
EP 2530227 A1 12/2012

(Continued)

OTHER PUBLICATIONS

ISA/JP, International Search Report dated Aug. 23, 2016 in International Application No. PCT/JP2016/069279, 4 pages with English translation.

(Continued)

*Primary Examiner* — Victor D Batson
*Assistant Examiner* — Matthew J Sullivan
(74) *Attorney, Agent, or Firm* — Masuvalley & Partners

(57) ABSTRACT

Provided are a hinge capable of attaching a door side member having a recessed portion to receive an articulation joint in an end surface of a thin door such as a glass door and a hinge bracket. The hinge of the present invention includes a main body side member to be attached to a main body; and a door side member to be attached to a door, rotatably connected to the main body side member via an articulation joint and having a recessed portion to receive at least a part of the articulation joint. The door side member includes an outer shell portion, a first holding piece projecting from the outer shell portion, and a second holding piece for sandwiching the door with the first holding piece in a thickness direction of the door within a range of the outer shell portion in the thickness direction of the door.

6 Claims, 10 Drawing Sheets

(52) U.S. Cl.
CPC ..... *E05Y 2600/41* (2013.01); *E05Y 2600/502* (2013.01); *E05Y 2600/626* (2013.01); *E05Y 2900/132* (2013.01); *E05Y 2900/20* (2013.01)

(56) References Cited

U.S. PATENT DOCUMENTS

| | | | | |
|---|---|---|---|---|
| 1,797,802 | A * | 3/1931 | Soss | E05D 3/16 16/369 |
| 2,040,279 | A * | 5/1936 | Soss | E05D 3/186 16/273 |
| 3,001,224 | A * | 9/1961 | Soss | E05D 3/16 16/276 |
| 6,966,150 | B2 * | 11/2005 | Chiang | E05D 5/0246 16/252 |
| 7,107,723 | B2 * | 9/2006 | Chiang | E05D 5/0246 49/388 |
| 8,650,713 | B2 * | 2/2014 | Migliorini | E05D 3/16 16/298 |
| 2008/0083086 | A1 * | 4/2008 | Lin | E05D 5/0246 16/252 |
| 2009/0188082 | A1 * | 7/2009 | Huang | E05D 5/0246 16/382 |
| 2014/0068893 | A1 * | 3/2014 | Hung | E05F 3/20 16/52 |
| 2017/0130497 | A1 * | 5/2017 | Yamaguchi | E05D 3/16 |

FOREIGN PATENT DOCUMENTS

| | | | |
|---|---|---|---|
| JP | S60-63668 | U | 5/1985 |
| JP | H06-37479 | U | 5/1994 |
| JP | 2008-144374 | A | 6/2008 |

OTHER PUBLICATIONS

EPO, Extended European Search Report dated Apr. 4, 2019 in EP Application No. 16841260.9, 4 pages.

* cited by examiner

Fig. 5A
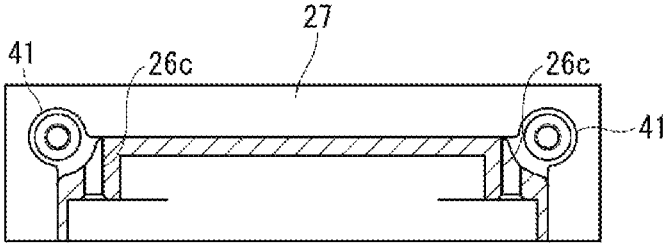
Cross-sectional view take along a line A-A
Fig. 5B
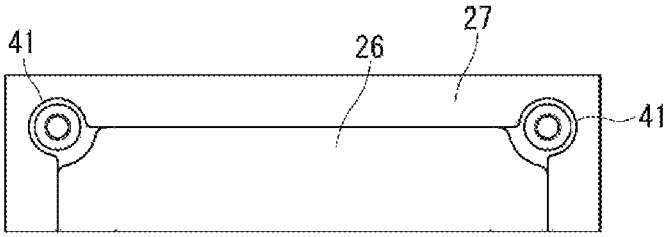
Fig. 5C
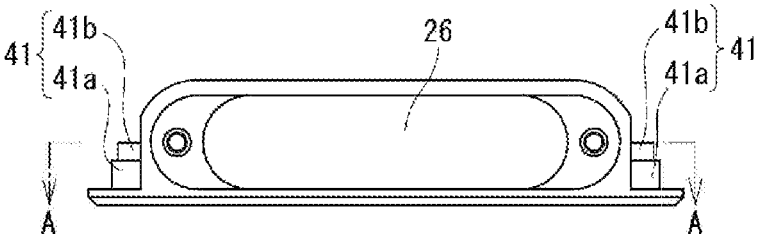
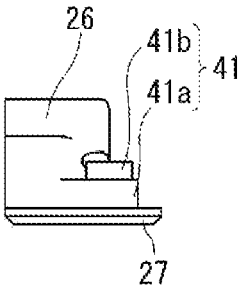
Fig. 5E
Fig. 5D
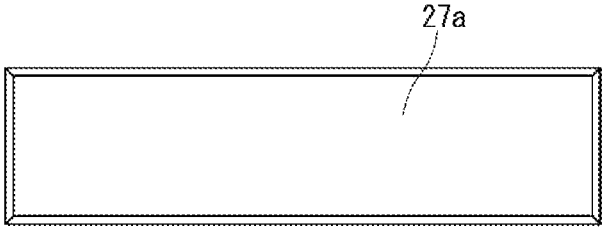

HINGE AND HINGE BRACKET

RELATED APPLICATIONS

This application is the U.S. National Phase of and claims priority to International Patent Application No. PCT/JP2016/069279, International Filing Date Jun. 29, 2016, which claims benefit of Japanese Patent Application No. 2015-174489 filed Sep. 4, 2015; both of which are incorporated herein by reference in their entireties.

TECHNICAL FIELD

The present invention relates to a hinge which enables a door to be opened and closed with respect to a main body, and a hinge bracket to attach the hinge.

BACKGROUND ART

A hinge includes a main body side member attached to a main body such as furniture, a building, and the like, and a door side member rotatably connected to the main body side member through an articulation joint and attached to the door. The articulation joint has various configurations. However, in order to increase an opening angle of the door with respect to the main body and/or to open the door while moving the door forward so as to avoid interference between the main body and the door, is known a hinge that the articulation joint is constituted from at least two links (see, for example, Patent Document 1).

In the hinge described in Patent Document 1: JPU H06-37479 A, both end portions of each link are rotatably connected to the main body side member and the door side member. The main body side member and the door side member are provided with recessed portions for receiving at least a part of the articulation joint. In a closed position of the door, the articulation joint is received in the recessed portion of the door side member and the recessed portion of the main body side member. According to the hinge disclosed in Patent Document 1: JPU H06-37479 A, since the articulation joint can be concealed at the closed position of the door, the design of the door is improved and the security performance is improved.

SUMMARY OF THE INVENTION

Incidentally, in the hinge disclosed in Patent Document 1: JPU H06-37479 A, since the main body side member and the door side member are provided with the recessed portions for receiving at least a part of the articulation joint, there is a problem that the widths (widths in a thickness direction of the door) of the main body side member and the door side member tend to become large. Therefore, it is difficult to attach the door side member to an end surface (side surface of the door) of a thin door such as a glass door.

Accordingly, it is an object of the present invention to provide a hinge capable of attaching the door side member having the recessed portion to receive the articulation joint in the end surface of the thin door such as the glass door, and a hinge bracket.

In order to solve the problem mentioned above, one embodiment of the present invention is directed to a hinge comprising: a main body side member to be attached to a main body; and a door side member to be attached to a door, rotatably connected to the main body side member via an articulation joint and having a recessed portion to receive at least a part of the articulation joint; wherein the door side member includes an outer shell portion, a first holding piece projecting from the outer shell portion, and a second holding piece for sandwiching the door with the first holding piece in a thickness direction of the door within a range of the outer shell portion in the thickness direction of the door.

The other embodiment is directed to a hinge bracket for attaching to a door side member main body of a hinge, the hinge including a main body side member to be attached to a main body, and a door side member main body to be attached to a door, rotatably connected to the main body side member via an articulation joint, and having a recessed portion to receive at least a part of the articulation joint; wherein the hinge bracket comprising: an outer shell portion for receiving the door side member main body and to be fixed to the door side member main body by a fixing member; a first holding piece protruding from the outer shell portion; and a second holding piece to sandwich the door with the first holding piece in a thickness direction of the door within a range of the outer shell portion in the thickness direction of the door.

According to the present invention, it is possible to attach the door side member or the door side member main body having the recessed portion to receive at least a part of the articulation joint in the end surface of the door such as the glass door.

BRIEF DESCRIPTION OF THE DRAWINGS

FIGS. 5A through 5E are the detailed view of an outer shell portion and a first holding piece of the hinge of the above embodiment (FIG. 5A is a cross-sectional view taken along a line A-A in FIG. 5C, FIG. 5B is a plan view, FIG. 5C is a front view, FIG. 5D is a bottom view, and FIG. 5E is a side view).

Hereinafter, a hinge according to an embodiment of the present invention will be described in detail with reference to the accompanying drawings. However, the hinge of the present invention can be embodied in various forms, and is not limited to the embodiments described in this specification. This embodiment is intended to provide those skilled in the art with a sufficient understanding of the scope of the invention by fully disclosing the specification.

Figure 1:
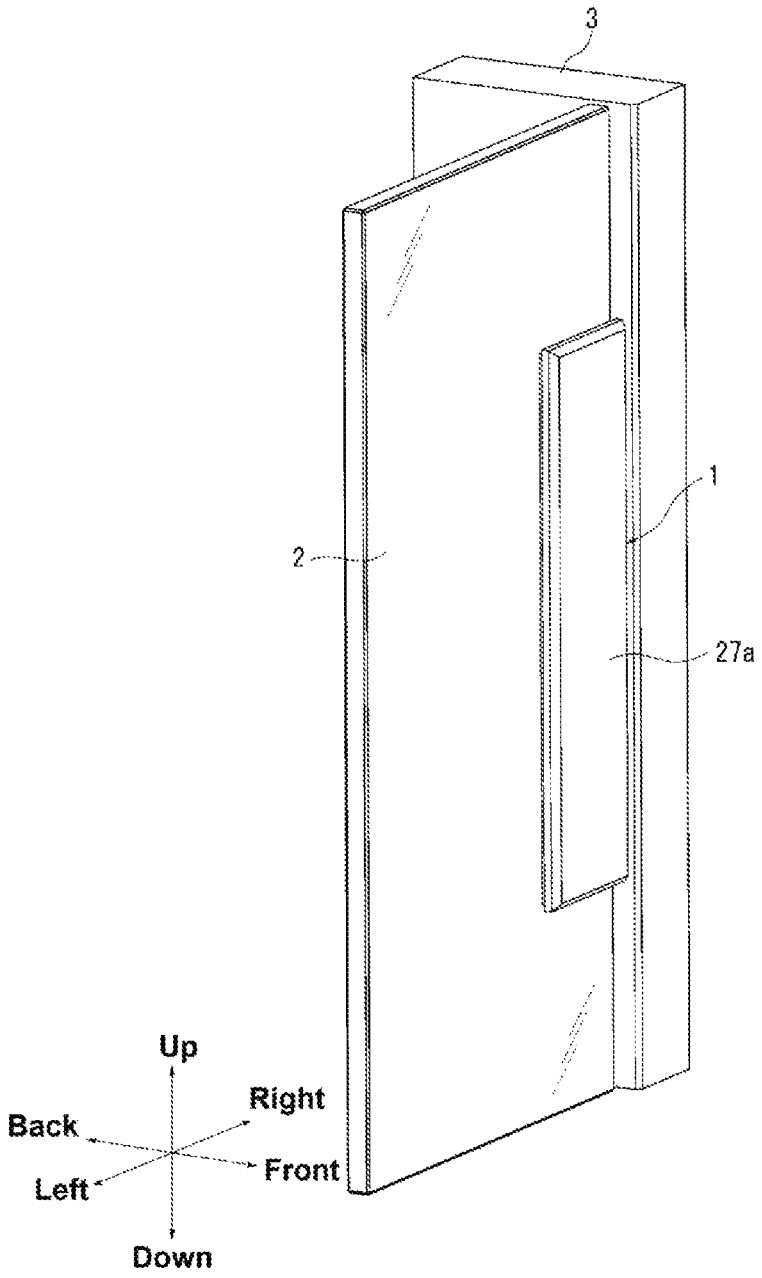
FIG. 1 is an enlarged perspective view of a building or furniture to which a hinge according to a first embodiment of the present invention is attached (a state in which a door is in a closed position).
Figure 2:
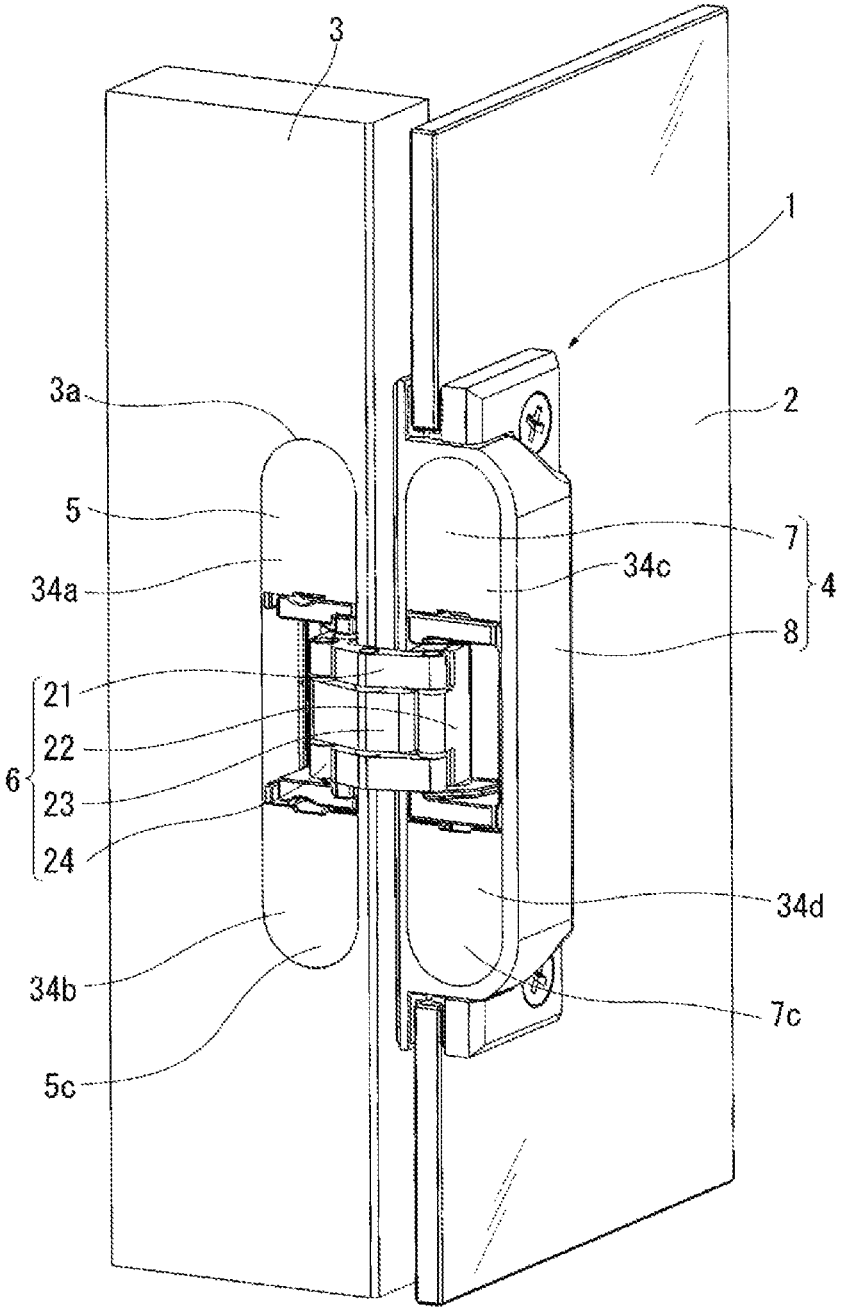
FIG. 2 is an enlarged perspective view of the building or furniture to which the hinge of the above embodiment is attached (a state in which the door is in an opened position).

FIG. 1 and FIG. 2 show perspective views of a building or furniture to which a hinge 1 according to a first embodiment of the present invention is attached. FIG. 1 shows a closed position of a door 2, and FIG. 2 shows an opened position of the door 2. In the following description, for the convenience of explanation, unless otherwise specified, the configuration of the hinge 1 will be explained using a direction when the door 2 is viewed from the front side, that is, a vertical direction, a horizontal direction, a front-back direction. Of course, the hinge 1 is not limited to such an arrangement.

As shown in FIG. 2, the hinge 1 includes a main body side member 5 attached to an inner surface of a frame 3 as a main body, and a door side member 4 attached to the door 2. On the inner surface of the frame 3, for example, a vertically elongated oval excavation 3*a* is provided. The main body side member 5 is received in the excavation 3*a* of the frame 3. The door side member 4 includes a door side member main body 7 rotatably connected to the main body side member 5 through the articulation joint 6 and a bracket 8 to receive the door side member main body 7. The door 2 such as a glass door is attached to the bracket 8.

The articulation joint 6 has a first link 21 whose one end portion is rotatably connected to the main body side member 5 and the other end portion is connected to the door side member main body 7 via a first auxiliary link 22, and a second link 23 whose one end portion is rotatably connected to the door side member main body 7 and the other end portion is connected to the main body side member 5 via a second auxiliary link 24. The articulation joint 6 allows the door 2 to rotate approximately 180° about a vertical axis from the closed position shown in FIG. 1 to the opened position shown in FIG. 2. The articulation joint 6 opens the door 2 while moving the door 2 forward so as to avoid interference between the door 2 and the frame 3. Adjustment screws 31*a*, 31*b* to 33*a*, 33*b* for fine-adjusting the position of the door 2 in the vertical, horizontal, and front-back directions are incorporated in the hinge 1 (see FIG. 3). The adjustment screws 31*a*, 31*b* to 33*a*, 33*b* are covered with threaded covers 34*a* to 34*d* having, for example, vertically elongated semi-elliptical shapes at both end portions in the vertical direction of the main body side member 5 and the door side member main body 7.

Figure 3:
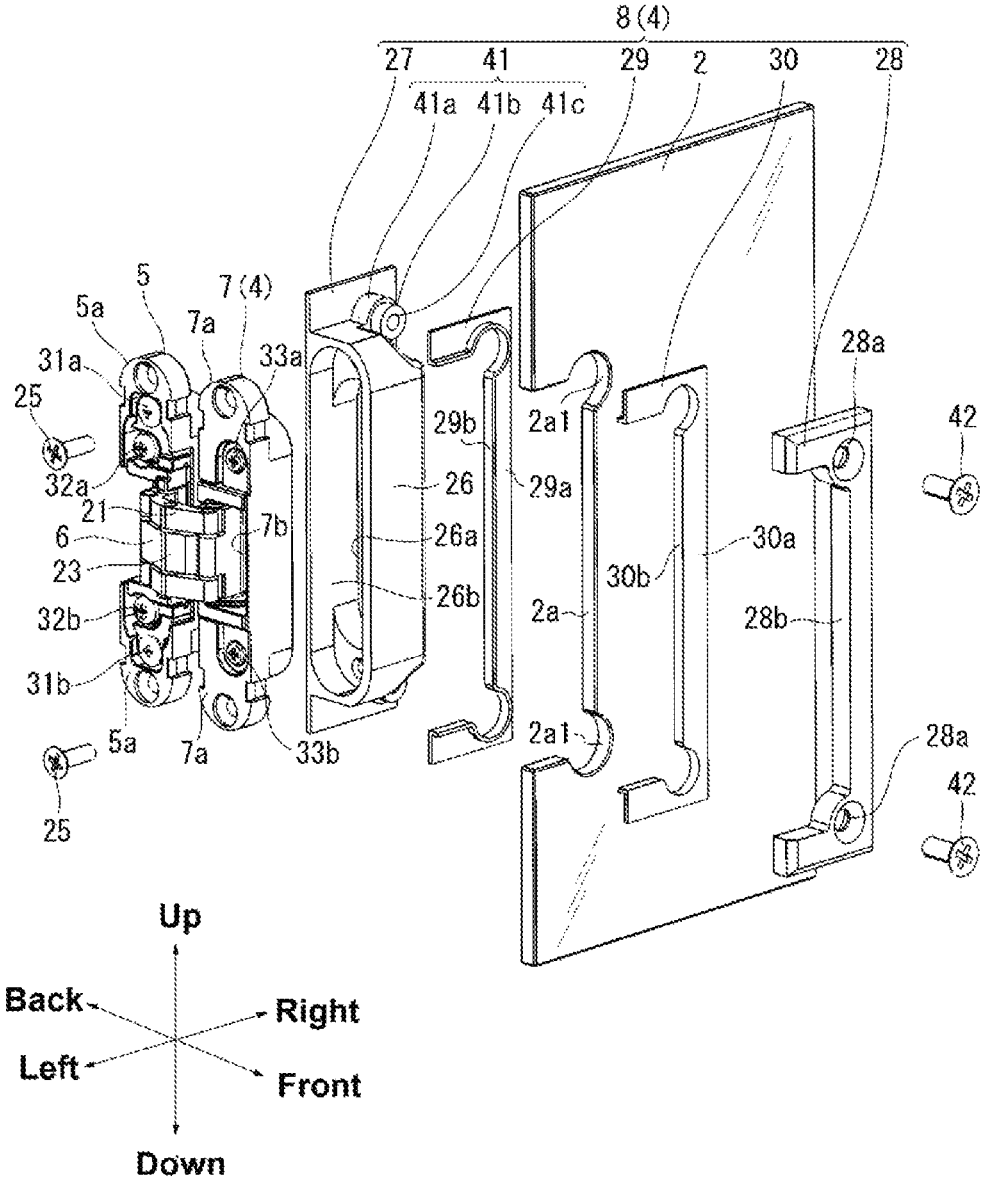
FIG. 3 is an exploded perspective view of the hinge of the above embodiment.

FIG. 3 shows an exploded perspective view of the hinge 1 of the first embodiment of the present invention. As described above, the hinge 1 includes the main body side member 5 and the door side member main body 7 rotatably connected to the main body side member 5 via the articulation joint 6. The main body side member 5 is a vertically elongated shape and has flanges 5*a* at both end portions in the vertical direction. Each of the flanges 5*a* is provided with a through hole. The main body side member 5 is attached to the frame 3 by a fixing member (not shown) such as screws. Like the main body side member 5, the door side member main body 7 is also a vertically elongated shape and has flanges 7*a* at both end portions in the vertical direction. Each of the flanges 7*a* is provided with a through hole. The door side member main body 7 is attached to the bracket 8 by a fixing member 25 such as screws. The configuration of the bracket 8 will be described later.

Figure 4:
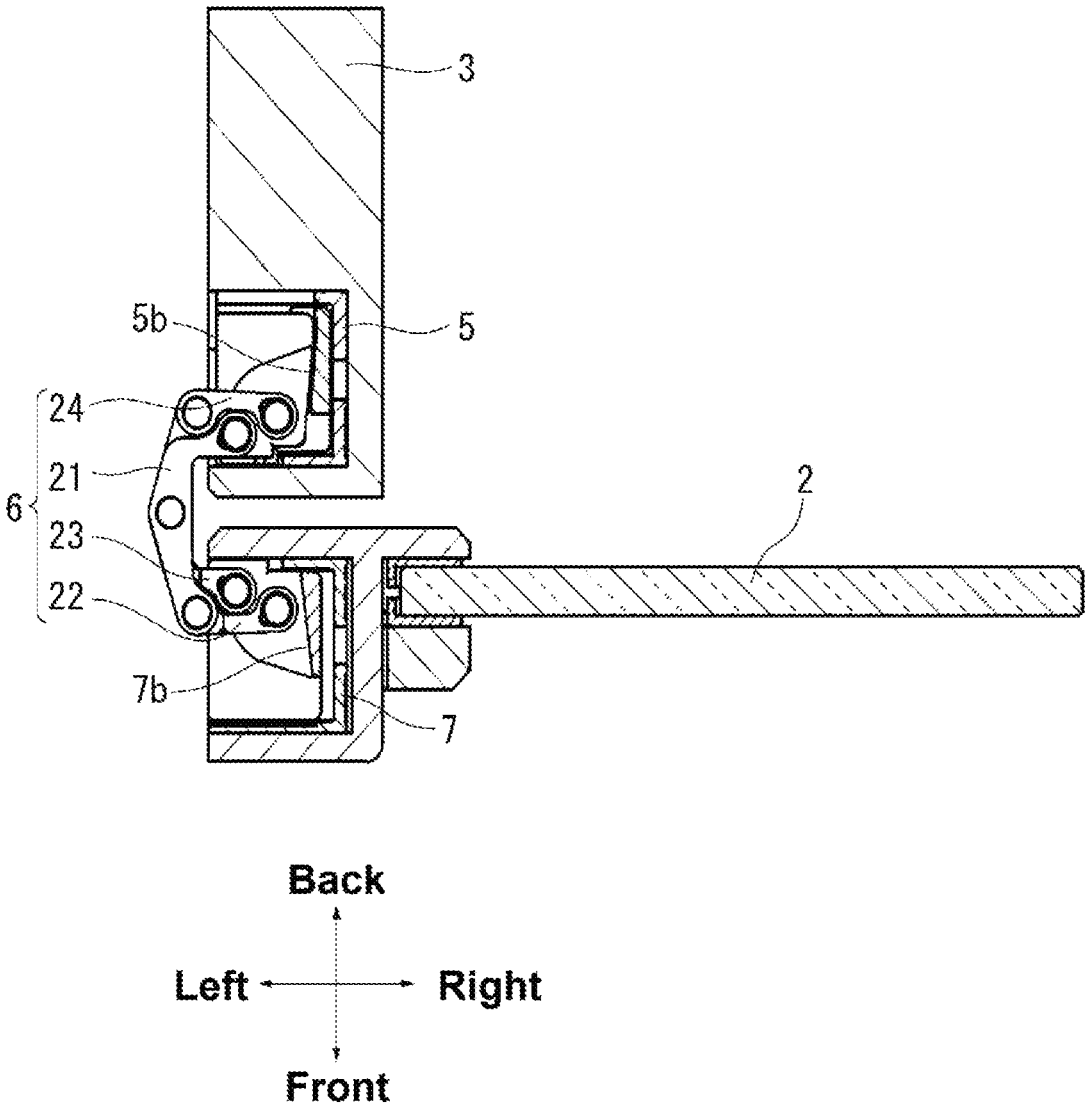
FIG. 4 is a horizontal sectional view of the hinge of the above embodiment.

As shown in the horizontal sectional view of FIG. 4, the articulation joint 6 includes the first link 21, the first auxiliary link 22, the second link 23, and the second auxiliary link 24. One end portion of the first link 21 is rotatably connected to the main body side member 5, and the other end portion thereof is rotatably connected to the first auxiliary link 22. One end portion of the first auxiliary link 22 is rotatably connected to the first link 21 and the other end portion thereof is rotatably connected to the door side member main body 7. One end portion of the second link 23 is rotatably connected to the door side member main body 7, and the other end portion thereof is rotatably connected to the second auxiliary link 24. One end portion of the second auxiliary link 24 is rotatably connected to the second link 23, and the other end portion thereof is rotatably connected to the main body side member 5. A central portion of the first link 21 and a central portion of the second link 23 are rotatably connected to each other. The articulation joint 6 is constituted by combining two quadric rotation chains, and has a total of seven axes.

The configuration of the articulation joint 6 is not limited to the above embodiment, and other configurations may be adopted. For example, instead of providing the first and second auxiliary links 22, 24, the other end portion of the first link 21 can be directly, rotatably and slidably connected to the door side member main body 7, and the other end portion of the second link 23 can be directly, rotatably and slidably connected to the main body side member 5. In this case, the articulation joint 6 has a total of five axes. Also, instead of providing the first and second auxiliary links 22, 24, both end portions of the first link 21 can be directly, rotatably and slidably connected to the main body side member 5 and the door side member main body 7, and both end portions of the second link 23 can be directly and rotatably connected to the main body side member 5 and the door side member main body 7. The first link 21 and the second link 23 are rotatably connected to each other. In this case, the articulation joint 6 has a total of five axes. Furthermore, the articulation joint can be constituted from an arm 73 rotating around a shaft 74 (see FIG. 10 and FIG. 11). In this case, the articulation joint has one shaft 74. A single-shaft type articulation joint will be described later.

As shown in FIG. 4, the main body side member 5 is provided with a box-shaped recessed portion 5*b*, and a part of the articulation joint 6 is received in the recessed portion 5*b*. Similarly, the door side member main body 7 is provided with a box-shaped recessed portion 7*b*, and a part of the articulation joint 6 is received in the recessed portion 7*b*. In the closed position of the door 2 shown in FIG. 1, the main body side member 5 and the door side member main body 7 face each other (as shown in FIG. 2, in the opened position of the door 2, the door side member main body 7 rotates substantially 180 degrees from the state that an end surface 5*c* of the main body side member 5 and an end surface 7*c* of the door side member main body 7 are substantially the same plane. In the closed position of the door 2, the end surface 5*c* of the main body side member 5 and the end surface 7*c* of the door side member main body 7 become substantially parallel. In the closed position of the door 2, the main body side member 5 and the door side member main body 7 substantially overlap when viewed from the horizontal direction.) In the closed position of the door 2 in FIG. 1, the articulation joint 6 is almost completely received in the recessed portion 5*b* of the main body side member 5 and the recessed portion 7*b* of the door side member main body 7.

As shown in FIG. 3, the hinge of this embodiment has a three-dimensional adjustment mechanism of the door 2. The three-dimensional adjustment mechanism includes vertical adjustment screws 31*a*. 31*b*, front-back adjustment screws 32*a*, 32*b* and front-back adjustment screws 33*a*, 33*b*. By loosening the vertical adjustment screws 31*a*, 31*b* provided on the main body side member 5, the position of the articulation joint 6 with respect to the main body side member 5 can be adjusted in the vertical direction. Further, by loosening the front-back adjusting screws 32*a*, 32*b*, the position of the articulation joint 6 with respect to the main body side member 5 can be adjusted in the front-back direction. Further, by turning the front-back adjusting screws 33*a*, 33*b* provided on the door side member main body 7, the position of the articulation joint 6 with respect to the door side member main body 7 is adjusted in the front-back direction. This three-dimensional adjustment mechanism is well known and can be omitted, so that a detailed description thereof will be omitted.

The bracket 8 includes an outer shell portion 26 to receive the door side member main body 7, a first holding piece 27 integral with the outer shell portion 26, and a second holding piece 28 for sandwiching the door 2 with the first holding piece 27. The outer shell portion 26 has a box shape having an elongated oval opening 26*a*. From a rear wall 26*b* of the outer shell portion 26, the plate-shaped first holding piece 27 protrudes in the vertical direction and a right direction. The first holding piece 27 (the first holding piece 27 when viewing the door 2 in the closed position shown in FIG. 1 from the front side) seen from the rear side has a vertically elongated rectangular shape. An end surface 27*a* (see FIG. 1) of the first holding piece 27 is a plane substantially parallel to the surface of the door 2. This is for improving the design of the door 2.

FIGS. 5A-5E show the detailed view of the outer shell portion 26 and the first holding piece 27. FIG. 5A shows a cross-sectional view taken along a line A-A in FIG. 5C, FIG. 5B shows a plan view (view viewed from the front-back direction in FIG. 3), FIG. 5C shows a front view, FIG. 5D shows a bottom view, and FIG. 5E shows a side view.

As shown in FIG. 5B, in the plan view, the outer shell portion 26 has a rectangular shape. At the two corners of the outer shell portion 26, a pair of arc-like convex portions 41 is provided so as to be connected to the outer shell portion 26. Each of the convex portions 41 has a large diameter portion 41*a* on the proximal end side and a small diameter portion 41*b* on the distal end side (see FIG. 3). As shown in FIG. 3, the small diameter portion 41*b* has a cylindrical shape and has a screw hole 41*c* on the inner surface to which the fixing member such as screws is screwed. A through hole 28*a* of the second holding piece 28 fits into the small diameter portion 41*b*. In order to avoid interference with the second holding piece 28, the outer shell portion 26 around the small diameter portion 41*b* is scraped off. The door side member main body 7 is fixed to the outer shell portion 26 by fixing members 25 such as screws extending in the horizontal direction in parallel with the door 2. As shown in FIG. 5A, the outer shell portion 26 is provided with screw holes 26*c* into which the fixing member 25 is screwed.

As shown in FIG. 3, the door 2 is provided with a substantially rectangular cutout 2*a*. At the two corners of the cutout 2*a*, a pair of arc-like auxiliary cutouts 2*al* matching in shape with the convex portions 41 of the first holding piece 27 is provided. The outer shell portion 26 and the convex portions 41 are fitted into the cutout 2*a* and the auxiliary cutouts 2*al* of the door 2. Thereby, it is possible to prevent the door 2 from being misaligned in the horizontal direction and the vertical direction with respect to the outer shell portion 26, and the door 2 from hanging down. The thickness of the door 2 is equal to or less than the thickness of the outer shell portion 26 (thickness in the front-back direction in FIG. 3).

The second holding piece 28 is in the form of a plate having substantially the same longitudinal and lateral dimensions (dimensions in the vertical direction and the horizontal direction) as those of the first holding piece 27. The second holding piece 28 is also provided with a cutout 28*b* matching the outer shell portion 26, and the second holding piece 28 is substantially C-shaped. The second holding piece 28 is fitted to the outer shell portion 26. Through holes 28*a* through which the fixing member 42 such as screws passes are provided at the corner portions of the second holding piece 28. The fixing member 42 extends in a direction perpendicular to the door 2 (front-back direction in FIG. 3). The door 2 can be fixed to the bracket 8 by sandwiching the door 2 between the first holding piece 27 and the second holding piece 28 and fixing the fixing member 42 to the screw holes 41*c* of the convex portions 41 of the first holding piece 27. The first holding piece 27 and the second holding piece 28 sandwich the door 2 within the range of the outer shell portion 26 in the thickness direction of the door 2. In other words, the end surface (the back end surface of the second holding piece 28 in FIG. 3) of the second holding piece 28 on the side of the door 2 is disposed closer to the first holding piece 27 than the end surface (the front end face of the outer shell portion 26 in FIG. 3) of the outer shell portion 26 on the side of the second holding piece 28.

A first spacer 29 is interposed between the first holding piece 27 and the door 2. The first spacer 29 has a main body portion 29*a* formed of a substantially C-shaped thin plate along the surface of the door 2 and an edge portion 29*b* extending along the cutout 2*a* of the door 2. A second spacer 30 is interposed between the second holding piece 28 and the door 2. The second spacer 30 has a main body portion 30*a* formed of a substantially C-shaped thin plate along the surface of the door 2 and an edge portion 30*b* extending along the cutout 2*a* of the door 2. The first and second spacers 29, 30 are made of a resin.

The configuration of the hinge of this embodiment has been described above. According to the hinge of the present embodiment, the following effects are obtained.

Since the door side member main body 7 are received in the outer shell portion 26 and the door 2 is sandwiched between the first holding piece 27 protruding from the outer shell portion 26 and the second holding piece 28, the door side member main body 7 having the recessed portion 7*b* to receive the articulation joint 6 can be attached to the end surface of the thin door 2 such as the glass door.

Here, if the articulation joint 6 is constituted from at least the first and second links 21, 23, the recessed portion 7*b* of the door side member main body 7 is also likely to become large. The hinge 1 of the present embodiment is suitable for the hinge in which the recessed portion 7*b* tends to become large.

By fixing the first holding piece 27 and the second holding piece 28 with the fixing member 42 such as the screws or the like, it is possible to securely fix the door 2 to the door side member 4.

Since the first and second spacers 29, 30 are interposed between the first and second holding pieces 27, 28 and the door 2, it is possible to prevent the door 2 from being scratched by bringing the first and second holding pieces 27, 28 made of the metal into contact with the door 2.

The door side member 4 is constituted from the door side member main body 7 and the bracket 8 and the door side member main body 7 is fixed to the outer shell portion 26 of the bracket 8 by the fixing member 25, so that the bracket 8 can be also attached to the existing hinge.

Figure 6:
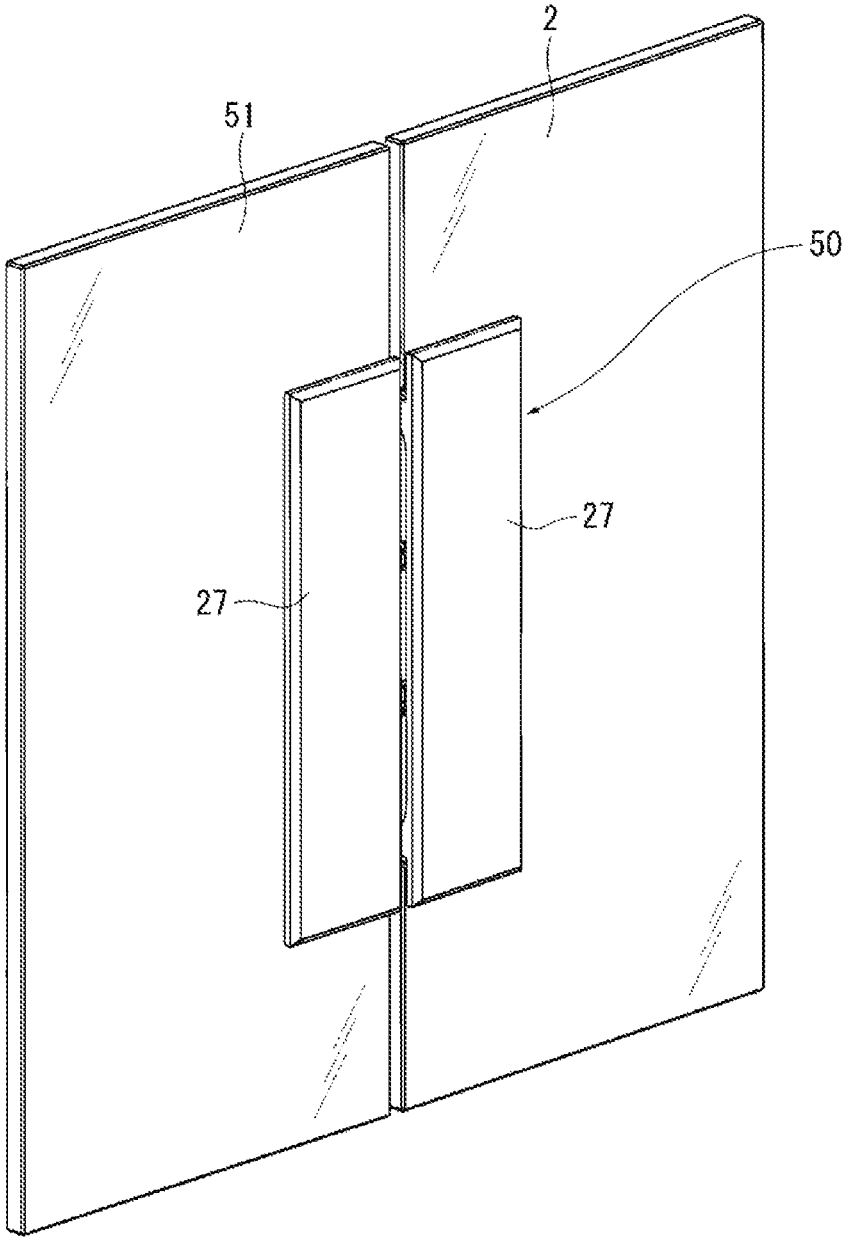
FIG. 6 is an enlarged perspective view of a building or furniture to which a hinge according to a second embodiment of the present invention is attached (a state in which a door is in a closed position).
Figure 7:
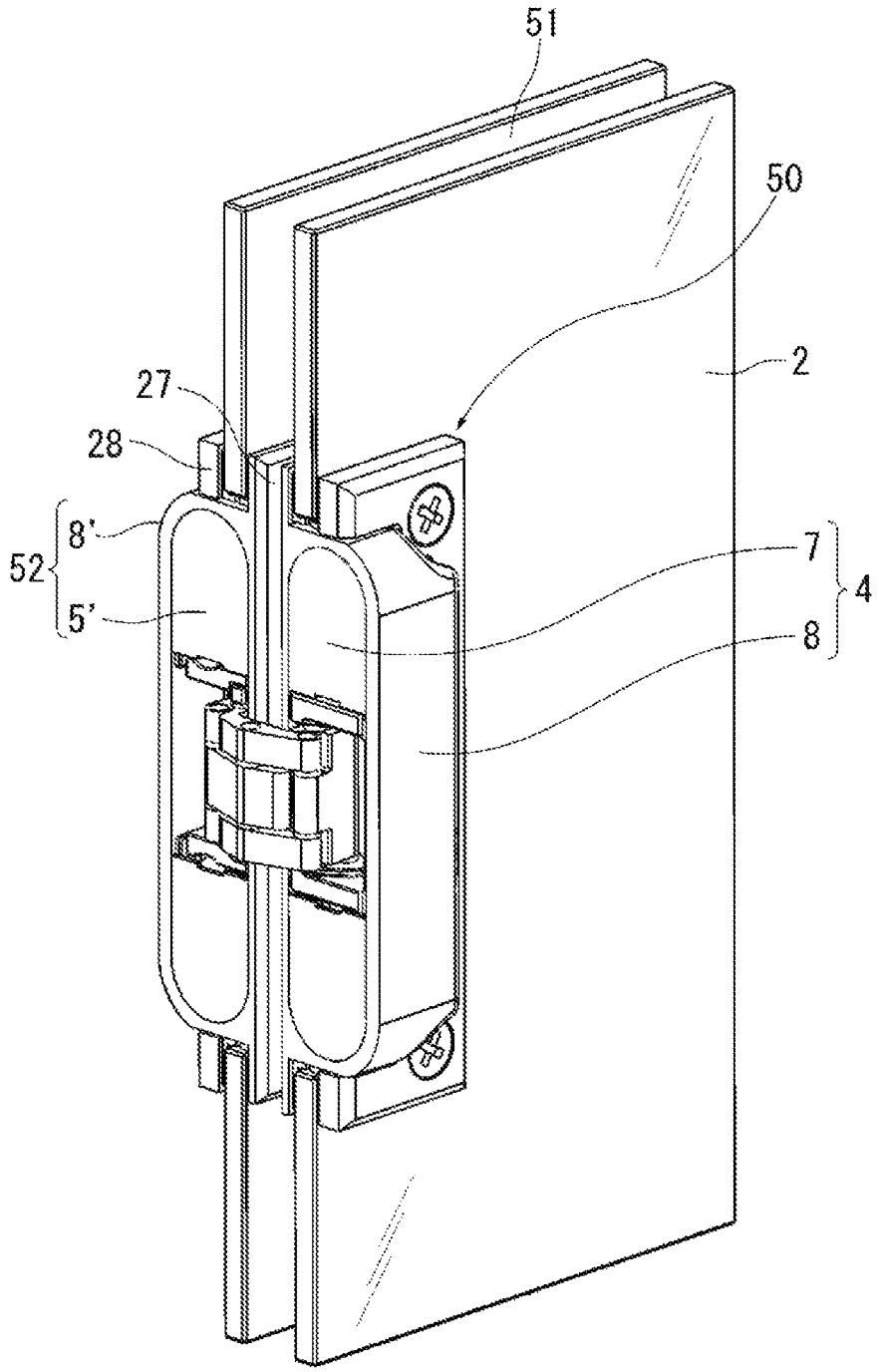
FIG. 7 is an enlarged perspective view of the building or furniture to which the hinge according to the second embodiment of the present invention is attached (a state in which the door is in an opened position).

FIG. 6 and FIG. 7 show a hinge 50 according to a second embodiment of the invention. The hinge 50 of this embodiment is applied to a folding door 2, 51. In this embodiment, a door 51 such as a glass door is attached not only to the door side member 4 but also to the main body side member 52. Thus, the main body of the present invention includes the door 51 such as the glass door. Since the configuration of the door side member 4 is the same as that of the first embodiment shown in FIG. 2 and FIG. 3, the same reference numerals are given and explanations thereof are omitted.

The main body side member 52 includes a main body side member main body 5' and a bracket 8' to which the main body side member main body 5' is attached. Since the configuration of the main body side member main body 5' is the same as that of the main body side member 5 shown in FIG. 3, the explanation thereof will be omitted by adding reference numeral 5'. As shown in FIG. 7, in the opened position of the door 2, the bracket 8' is arranged symmetrically with the bracket 8. Like the bracket 8, the bracket 8' has the outer shell portion 26, the first holding piece 27 integral with the outer shell portion 26, and the second holding piece 28 for sandwiching the door 2 with the first holding piece 27. Since these configurations are the same as those of the bracket 8 shown in FIG. 3, the description thereof will be omitted by attaching the reference numeral 8'.

Figure 8:
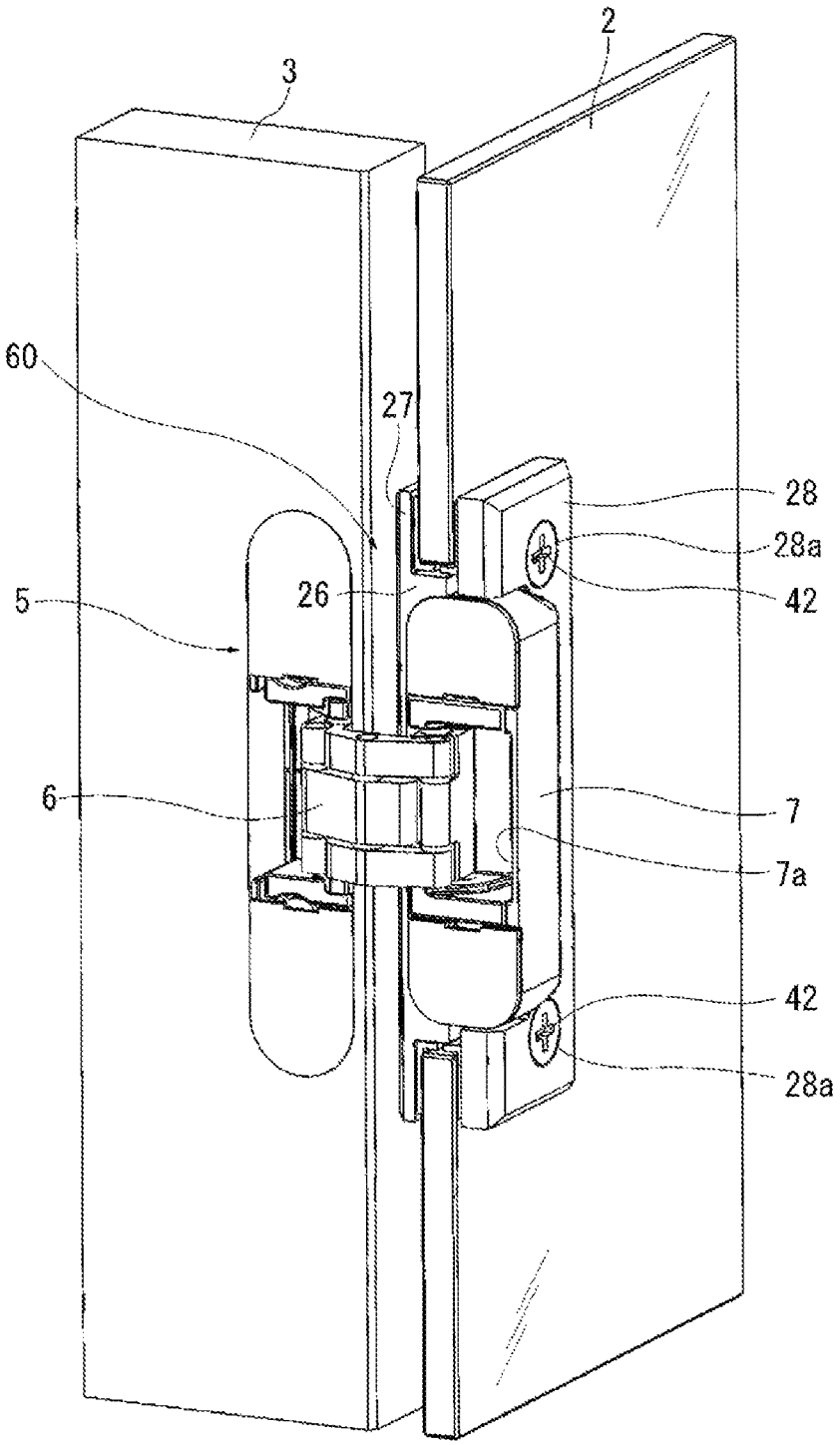
FIG. 8 is an enlarged perspective view of a building or furniture to which a hinge according to a third embodiment of the present invention is attached (a state in which a door is in an opened position).
Figure 9:
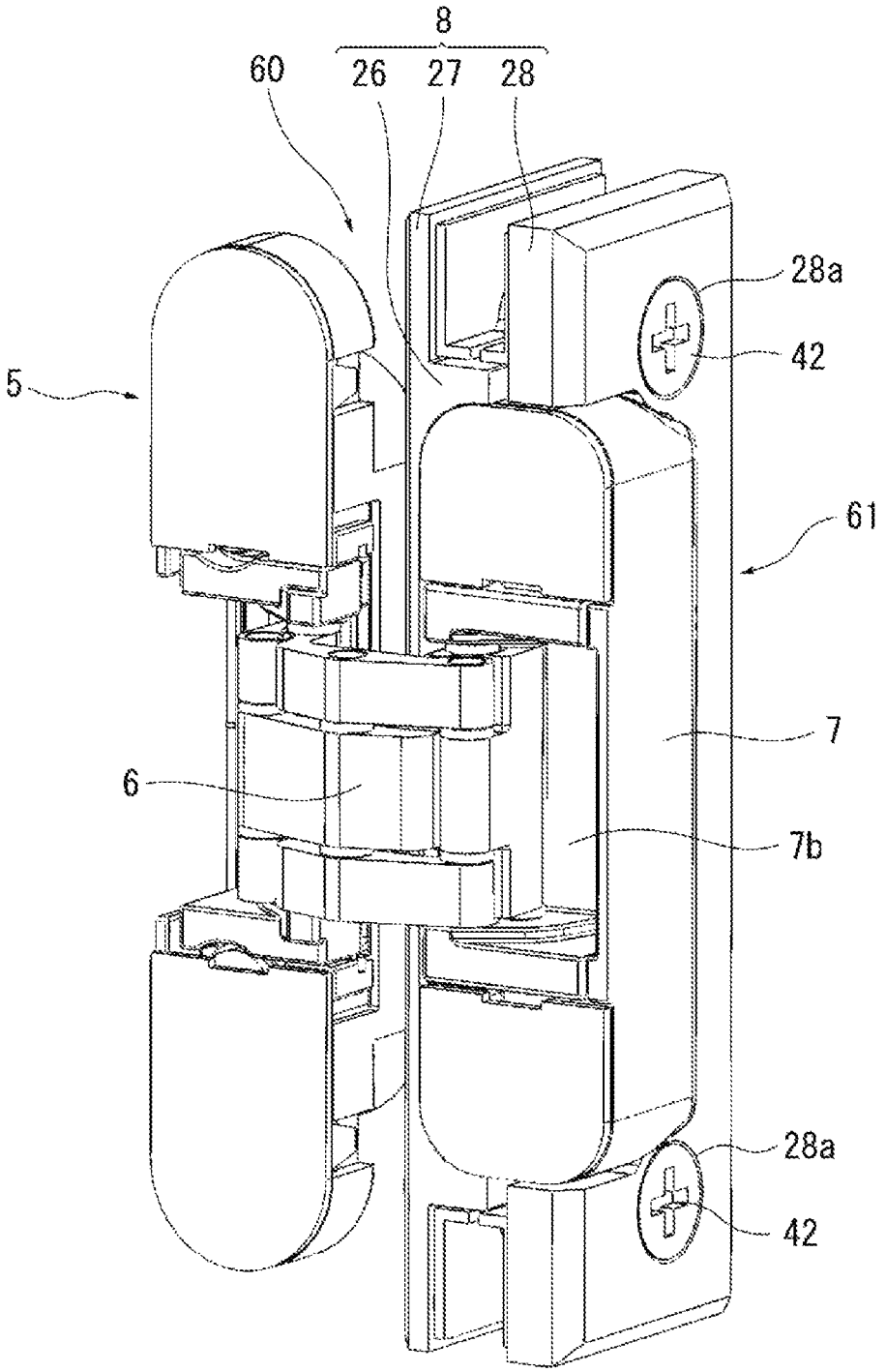
FIG. 9 is a perspective view of the hinge according to the third embodiment of the present invention (the state in which the door is in the opened position).

FIG. 8 and FIG. 9 show a hinge 60 according to a third embodiment of the invention. FIG. 8 shows the hinge 60 in a state of being attached to the frame 3 and the door 2 and FIG. 9 shows the hinge 60 in a state of being removed from the frame 3 and the door 2. In the hinge 1 of the first embodiment shown in FIG. 3, the door side member main body 7 and the outer shell portion 26 of the bracket 8 are separate members, and the door side member main body 7 is attached to the outer shell portion 26 of the bracket 8 by the fixing member 25. On the other hand, in the hinge 60 of this embodiment, the door side member main body 7 and the outer shell portion 26 of the bracket 8 and the first holding piece 27 are integrated. Since the configurations of the door side member main body 7, the bracket 8, and the main body side member 5 are substantially the same as those of the hinge 1 of the first embodiment, the same reference numerals are given and the description thereof is omitted.

In the hinge 60 according to the third embodiment, the door side member 61 includes the outer side portion 26 integral with the door side member main body 7, the first holding piece 27 integral with the outer side portion 26, and the second holding piece 27 which sandwiches the door 2 with the first holding piece 28. The outer shell portion 26 is provided with the recessed portion **7*b* in which at least a part of the articulation joint 6 is received. Except that the door side member main body 7 and the outer shell portion 26 are integrated, since these configurations are substantially the same as the hinge 1 of the first embodiment, the same reference numerals are given and the description thereof will be omitted. It becomes possible to fix the door 2 between the first and second holding pieces 27, 28 by passing the fixing member 42 through the through holes 28*a* of the second holding piece 28 and fixing the fixing member 42 to the first holding piece 27**.

It should be noted that the present invention is not limited to being embodied in the above-described embodiment, and can be modified in various embodiments within the scope not changing the gist of the present invention.

For example, other than the glass door, a resin door such as an acrylic plate, a wooden door, a metal door and the like can be used for the door.

Figure 10:
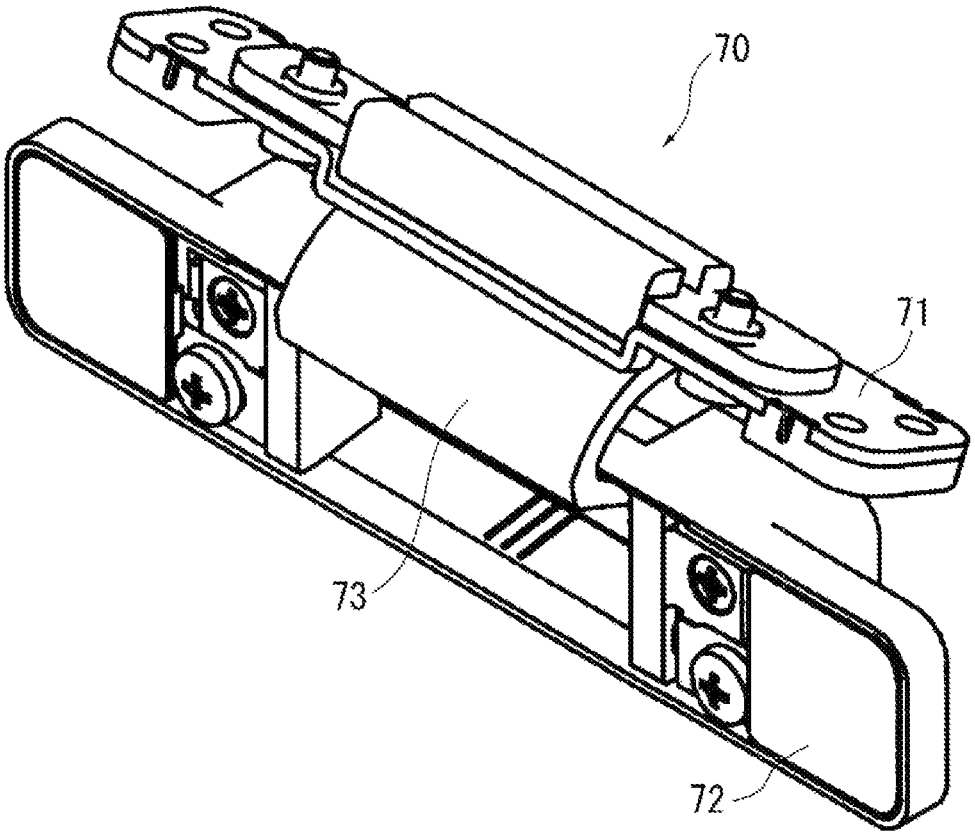
FIG. 10 is a perspective view of a single-shaft type hinge to which the present invention can be applied.
Figure 11:
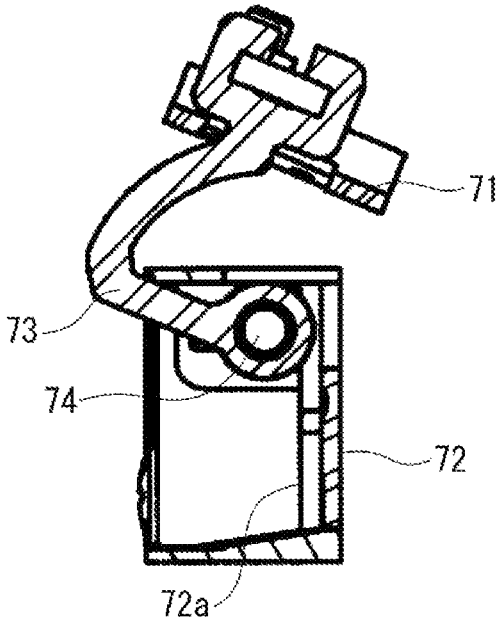
FIG. 11 is a cross-sectional view perpendicular to a rotation axis of the hinge of FIG. 10.

For example, an arm that can rotate around one axis can be used for the articulation joint. FIG. 10 shows a perspective view of a single-shaft type hinge 70 to which the present invention can be applied. The hinge 70 includes a main body side member 71 attached to a main body such as a frame and a door side member main body 72 attached to the door. The door side member main body 72 is rotatably connected to the main body side member 71 via an arm 73 as the articulation joint. As shown in the cross-sectional view of FIG. 11, a proximal end portion of the arm 73 is rotatably connected to the door side member main body 72 via a shaft 74. The proximal end portion of the arm 73 is received in a recessed portion **72*a* of the door side member main body 72. A distal end portion of the arm 73 is fixed to the main body side member 71. When the bracket 8 shown in FIG. 3 is attached to the door side member main body 72, a thin door can be attached to the door side member main body 72**.

This specification is based on Japanese Patent Application No. 2015-174489 filed on Sep. 4, 2015. All of this content is incorporated here.

What is claimed is:

1. A hinge comprising:

a main body side member to be attached to a main body; and a door side member to be attached to a door, rotatably connected to the main body side member via an articulation joint and having a recessed portion to receive a shaft of the articulation joint;

wherein the door side member includes an outer shell portion, a first holding piece projecting from the outer shell portion, and a second holding piece for sandwiching the door with the first holding piece in a thickness direction of the door within a range of the thickness of the outer shell portion in the thickness direction of the door;

wherein, in the state where the door is sandwiched by the first holding piece and the second holding piece, an end surface of the second holding piece on the side of the door is disposed closer to the first holding piece in the thickness direction than an end surface of the outer shell portion on the side of the second holding piece;

wherein the articulation joint includes at least, a first link having one end portion rotatably connected to the main body side member and the other end portion rotatably and movably connected to the door side member or the other end portion connected to the door side member via a first auxiliary link, and a second link having one end portion rotatably connected to the door side member and the other end portion rotatably and movably connected to the main body side member or the other end portion connected to the main body side member via a second auxiliary link, wherein the first link and the second link are rotatably connected to each other.

2. The hinge as claimed in claim 1, wherein the articulation joint includes an arm whose distal end portion is fixed to the main body side member and proximal end portion is rotatably connected to the door side member.

3. The hinge as claimed in claim 1, the second holding piece is fixed to the first holding piece by a fixing member.

4. The hinge as claimed in claim 1, wherein a first spacer is interposed between the first holding piece and the door, and a second spacer is interposed between the second holding piece and the door.

5. The hinge as claimed in claim 1, wherein the door side member includes a door side member main body having the recessed portion and a bracket having the outer shell portion, the first holding piece and the second holding piece, and wherein the door side member main body is received in the outer shell portion and fixed to the outer shell portion by a fixing member.

6. A hinge bracket for attaching to a door side member main body of a hinge, the hinge including a main body side member to be attached to a main body, and a door side member main body to be attached to a door, rotatably connected to the main body side member via an articulation joint, and having a recessed portion to receive at least a part of the articulation joint; wherein the hinge bracket comprising:

an outer shell portion for receiving the door side member main body and to be fixed to the door side member main body by a fixing member;

a first holding piece protruding from the outer shell portion; and a second holding piece to sandwich the door with the first holding piece in a thickness direction of the door within a range of the thickness of the outer shell portion in the thickness direction of the door;

wherein, in the state where the door is sandwiched by the first holding piece and the second holding piece, an end surface of the second holding piece on the side of the door is disposed closer to the first holding piece in the thickness direction than an end surface of the outer shell portion on the side of the second holding piece;

wherein the articulation joint includes at least, a first link having one end portion rotatably connected to the main body side member and the other end portion rotatably connected to the door side member or the other end portion connected to the door side member via a first auxiliary link, and a second link having one end portion rotatably connected to the door side member and the other end portion rotatably connected to the main body side member or the other end portion connected to the main body side member via a second auxiliary link, wherein the first link and the second link are rotatably connected to each other.

* * * * *